United States Patent [19]

Klok

[11] 4,330,104

[45] May 18, 1982

[54] HYDRAULIC JACK AND STAND COMBINATION WITH KEY AND HINGED HANDLE

[76] Inventor: Henri Klok, P.O. Box 13714, Houston, Tex. 77019

[21] Appl. No.: 5,837

[22] Filed: Jan. 23, 1979

[51] Int. Cl.[3] ..... B66F 3/24

[52] U.S. Cl. ..... 254/93 H; 254/DIG. 1; 254/DIG. 3; 254/DIG. 4; 254/93 A

[58] Field of Search ..... 254/93 H, 93 R, 93 A, 254/DIG. 4, DIG. 3, DIG. 1; 248/354 R, 354 P, 354 S, 354 C

[56] References Cited

U.S. PATENT DOCUMENTS 2,514,095 7/1950 Schreiber ..... 248/354 C 2,736,531 2/1956 Wilson ..... 254/93 H

*Primary Examiner*—Robert C. Watson

[57] ABSTRACT

A combination of a hydraulic jack with a triangulated steel stand interlocked with a novel, key-secured, ribbed cylinder of high strength light weight alloy, thread-connected to the lifting ram of the jack. Fast finder funnels are enjoined for rapid setting and operating of the combination with a handle having a 90° bend at one extremity and a hinged center engaged by a spring released sleeve restrainer.

1 Claim, 4 Drawing Figures

HYDRAULIC JACK AND STAND COMBINATION WITH KEY AND HINGED HANDLE

CROSS REFERENCES

A search has established no jack of comparable quality, although a similarity in principle was found in U.S. Pat. No. 3,567,183 but whose integral design included the pin-type lock deemed clumsy and hard to clear in actual operations as well as other obvious non-equalities to this application . Other common hydraulic jacks surveyed included: U.S. Pat. Nos. 4,050,674; 3,844,534; 3,890,684; and 3,959,970.

SUMMARY OF THE INVENTION

The conventional hydraulic jack is combined with the simple triangulated stand function through the utilization of a key-secured ribbed cylinder which is thread connected to the projecting ram of the said jack and operated to its desired height including the conventional thread extension of the bearing head. The key setting allows the hydraulic pressure to be relieved for the duration of the work beneath the loading situation and henceforth functions as a typical stand until said jack is re-engaged. Fast finder funnels allow rapid operation of the main jacking piston and set screw features of the conventional jack. A 90° bend in the operating handle and a funnel pipe attachment on one leg of the stand permit sliding and positioning of said invention beneath the required work. The handle is hinged to permit storage on the plate portion of said invention by conventional steel clips.

DESCRIPTION OF THE PREFERRED EMBODIMENT

Figures 1, 2, 3:
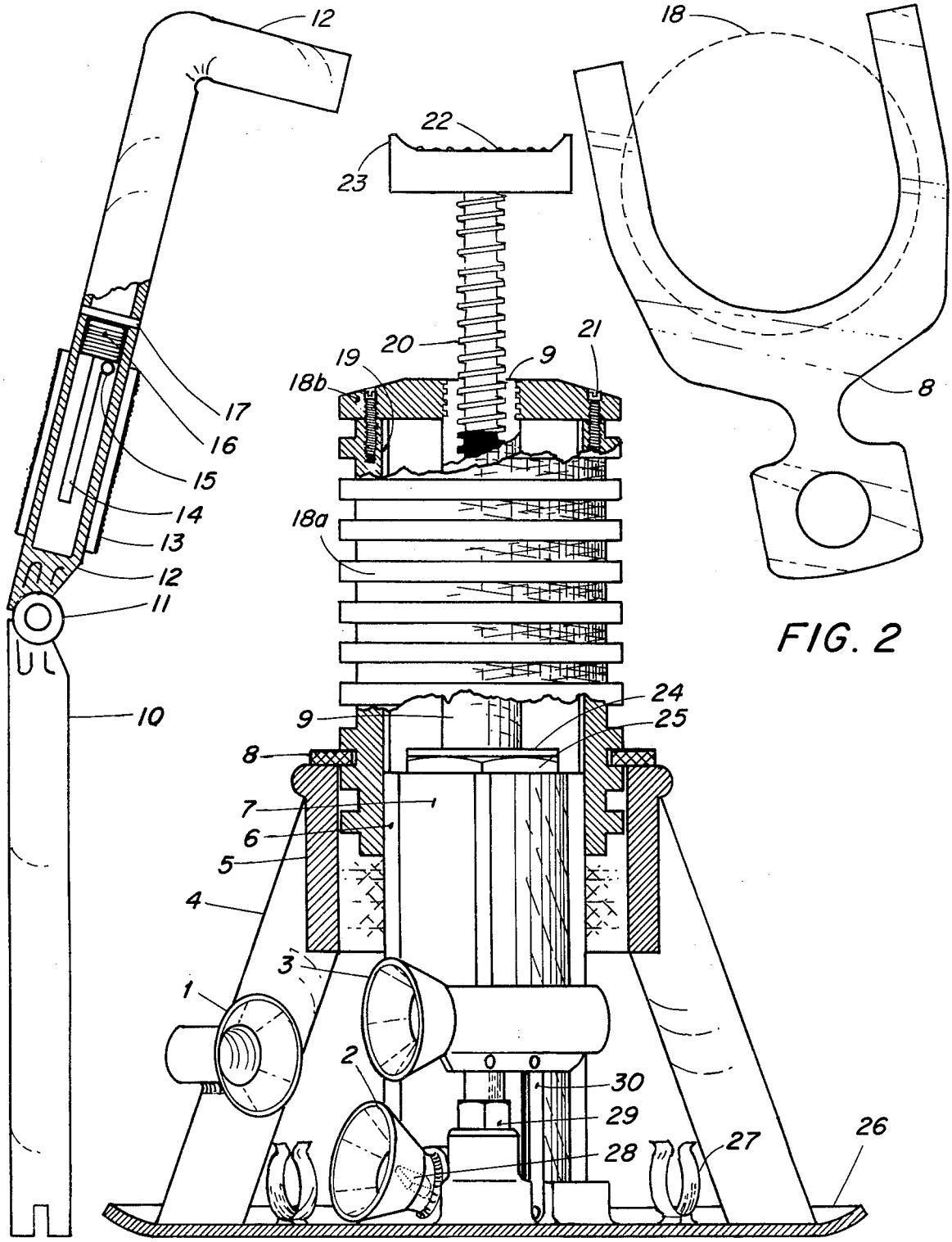
FIG. 1 is an elevation of said invention sectioned to permit viewing of the internal working components and illustration of the fast finder funnels as applied to said invention.
FIG. 2 is the plan of the key used to secure the ribbed cylinder from receding and is sectioned on FIG. 1.
FIG. 3 is the hinged handle with a section of the spring sleeve restrainer and illustration of the push-pull 90° bend.
Figure 4:
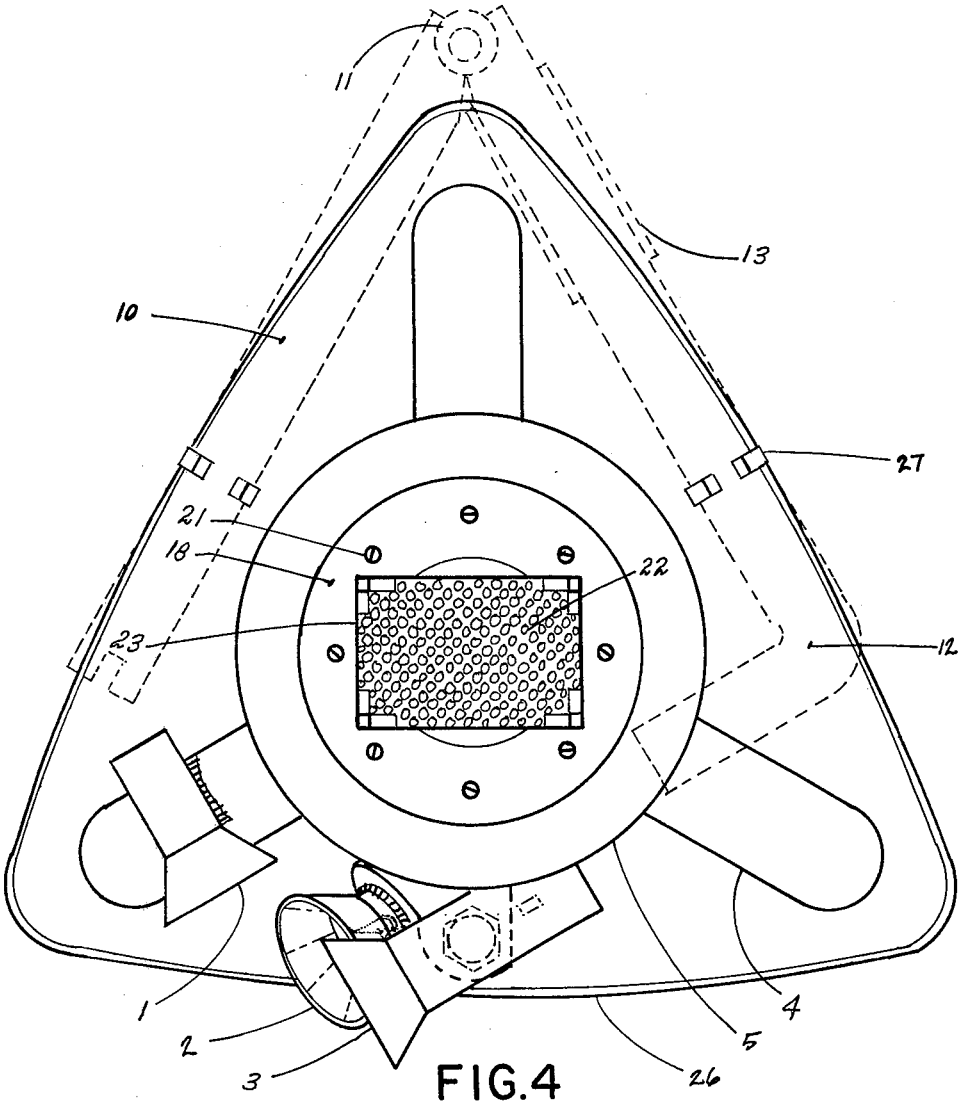
FIG. 4 is the plan of said invention illustrating the storage concept for the hinged handle as well as the plan view of the textured bearing head.

The combination of the hydraulic jack 7 and the stand 4 with the ribbed cylinder 18 and the locking key 8 provide the essential components of said invention; however, in order to completely describe in detail said invention it is necessry to review all the aspects of the components. First the hydraulic jack 7 is a sealed fluid compression device welded to a base plate 26 and provided with a set screw 28 which prevents the fluid from re-entering a fluid reservoir within the main casing of the jack structure 7. Also within the jack 7 is a lift bearing ram 9 that is extruded upon the accumulation of fluid pressure by the action of the piston assembly 29 that is manually moved up and down with the aid of a handle F-3 inserted into funnel guide and channel 3 and the pivoting action created by the dual hinged member 30 that restrains and deflects the main pumping channel 3 into an accurate straight lift within the piston assembly 29. In the event that full extrusion of the bearing ram 9 is insufficient, contained within the ram 9 is a threaded extension that yields on the average one-third greater height. Since this is a jack and stand combination, the bearing head 23 is of a dual nature as well, affording common jacking support as well as a stable long-term non-slip texture 22 plus the restraining corners of the bearing head 23 itself. Having now elevated the jack assembly, the bearing ram 9 can be observed to have the ribbed cylinder cap **18*b* threaded onto the uppermost portion of ram 9 with screws 21 securing the top stress cap 18*b* to the main cylinder 18*a*. The stress cap can thereby be removed to have access to the steel gasket 24 and cap nut 25 in order to service the jack 7. The external cylinder 18*a* is provided with alternating ribs to match the contour of lock key 8 so that upon loading, the weight will be transferred from the ribbed cylinder 18*a* to the steel rim 5 of the jack stand assembly. In order to provide a non-torsional or uneven leaning of said cylinder 18*a* the interior walls of said cylinder 18*a* are provided with four dadochannels 19 that mesh with four straight ribs 6 maintained on the exterior of the jack cylinder 7. There should be an adequate tolerance between channels 19 and ribs 6 so as not to restrict the normal lifting action of the bearing ram 9. Shown on the drawings are three tubular steel stand legs 4 so as to provide smooth carrying and pick-up ability for said invention as a whole. These legs 4 are welded to the support rim 5 and to the base plate 26 making the essential stand structure. The base plate 26 is contoured around its edge to facilitate the push-pull of said invention during setting operations. Two standard securing clips 27 are screwed to the base plate 26 so as to clamp in storage the jack operating handle F-3. The jack handle F-3 is a pipe hinged in the center and provided with a spring activated 16 steel casing 13 that locks handle sections 10 and 12 into a rigid extension. The steel casing 13 is manually retracted and twisted into "lock" position 15. Section 12 of the handle F-3 maintains a 90° bend to be utilized in the push-pull operation of sain invention by interfitting with a funnel guided pipe 1 welded to one of the jack stand's support legs 4**.

It is important to note that the handle (FIG. 3) has three distinct functions which are listed herewith in the common mode of use. First the handle (FIG. 3) bent section (12) is inserted into the funnel pipe attachment that is welded to one leg (4) of the stand portion of said jack and stand combination. Then the jack and stand combination can be pushed or pulled into the desired location for utilization. Second the handle's (FIG. 3) opposite end (10) is inserted through the funnel on the base of the jack portion securing through its notched tip to the fluid retention valve (28) thence operated by the twisting of the handle (FIG. 3) to either hold the fluid in check in one direction or to release the fluid by a twist in the opposite direction causing respectively an arrangement for lifting of said jack ram or lowering of same dependent in the former case on the required pumping action hereafter described. Third the handle (FIG. 3) is inserted utilizing the straight end (10) into the funnel guide (3) located on the pumping assembly so as to provide the necessary pumping action to raise said jack bearing ram. (23).

The claims forthwith stated for said invention comprise only the subjects considered novel and of significant enough nature to be considered justifiable innovations to the mechanical process of the class in which said invention is contained. These claims do not include the now conventional construction of hydraulic jacks nor the conventional triangulated stands in common useage but rather cover the integration of the two herewith noted structures into a utilitarian construction not previously available. Please also note that the said invention can be increased or decreased in scale to suit variable bearing loads as required. Having thus prefixed the claims status of the said invention, what stands to be the concise claims are numerically itemized below:

I claim:

1. I claim an integrated construction whose improvement comprises a conventional hydraulic jack combined with a simple triangulated steel stand with three engaging legs that commence at a steel base plate and project upwards to reengage at a steel ring that circumscribes a conventional hydraulic jack which has a modified bearing assembly that connects by means of a U-shaped and separate key to the aforementioned steel ring, thereby allowing a load to be distributed to the stand; said modified bearing assembly is of an inverted cylinder construction whose exterior is formed in consecutively arranged support ribbing whose purpose is to engage said separate key at predetermined locations according to desired height to be maintained once said load is transferred to said stand construction; said modified inverted cylinder is attached to the bearing ram of said conventional jack by means of machined threads and screws to provide a stable continuity to the bearing ram which is maintained to be pumped up by means of a fluid retention cavity and manually applied pressures; said steel stand assembly is hence combined to form an integrated structure with the additional features of selectively applied funnels whose sole purpose are to guide a steel handle to three locations of jack or stand function as listed herein; to engage a funnel on one of the stand's three legs so that said hydraulic jack and its contiguous stand could be moved about without entering a person or operator beneath said load, to engage the funnel that would guide said handle to the housing of the pumping mechanism standard on conventional hydraulic jacks, to engage said handle through the aid of a third and final funnel that would allow said handle to engage the fluid retention valve common to conventional hydraulic jacks.

* * * * *